US007252513B1

(12) United States Patent
Hildebrand et al.

(10) Patent No.: US 7,252,513 B1
(45) Date of Patent: Aug. 7, 2007

(54) COAXIAL RF CONNECTION DEVICE ELECTRICALLY CONNECTED TO A PRINTED CIRCUIT BOARD AS WELL AS ASSOCIATED CONNECTOR UNIT

(75) Inventors: Rudolf Hildebrand, Holzkirchen (DE); Gerhard Vogt, Rosenheim (DE)

(73) Assignee: Kathrein-Werke KG, Rosenheim (DE)

( * ) Notice: Subject to any disclaimer, the term of this patent is extended or adjusted under 35 U.S.C. 154(b) by 0 days.

(21) Appl. No.: 11/604,385

(22) Filed: Nov. 27, 2006

(30) Foreign Application Priority Data

Dec. 23, 2005 (DE) ..... 20 2005 020 107 U

(51) Int. Cl.
*H01R 12/00* (2006.01)

(52) U.S. Cl. ..... 439/63; 439/581

(58) Field of Classification Search ..... 439/63, 439/581

See application file for complete search history.

(56) References Cited

U.S. PATENT DOCUMENTS

| | | | | |
|---|---|---|---|---|
| 4,603,926 | A | 8/1986 | Nesbit et al. | |
| 6,793,501 | B1 * | 9/2004 | Leeman et al. | 439/63 |
| 7,163,405 | B2 * | 1/2007 | Geil et al. | 439/63 |
| 2002/0111057 | A1 | 8/2002 | Bernat et al. | |

FOREIGN PATENT DOCUMENTS

| | | |
|---|---|---|
| CA | 2377275 | 9/2002 |
| DE | 197 20 678 C1 | 10/1998 |
| DE | 10138545 | 8/2002 |
| DE | 101 15 479 A1 | 10/2002 |
| DE | 101 33 295 A1 | 1/2003 |
| DE | 103 13 664 B3 | 1/2004 |
| DE | 10255549 A1 | 6/2004 |
| DE | 202004015503 U1 | 1/2005 |
| DE | 20 2005 004 658 U1 | 7/2005 |
| DE | 202006000720 | 5/2006 |
| EP | 1286414 | 2/2003 |
| EP | 1 648 049 A1 | 4/2006 |
| JP | 06045779 | 2/1994 |
| WO | WO2006087225 | 8/2006 |

OTHER PUBLICATIONS

Search report issued in EP 06 02 4348 dated Feb. 14, 2007 and received by Applicant on Feb. 27, 2007.

* cited by examiner

*Primary Examiner*—Tho D. Ta
(74) *Attorney, Agent, or Firm*—Nixon & Vanderhye PC

(57) ABSTRACT

An improved plug connection device has projections aligned parallel with the axial direction of the connectors, by means of which the connector unit is positioned or can be positioned perpendicularly to the plane of the printed circuit board. The connector unit has, on the side facing the printed circuit board, devices forming a support surface and/or boundary plane, on which the adjacent plane of the printed circuit board lies on the connector unit. The connector unit has on a side facing the printed circuit board, at least in sections, a free space (X1), provided with at least one recess and/or recesses. The recesses lie at a distance to the adjacent plane of the printed circuit board, and/or the outer contacts of the connectors are arranged transversely offset to one another in such a way that a free space (X2) is formed between the connectors. The free space (X1) and/or the free space (X2) serve as room for routing and/or populating the printed circuit board.

33 Claims, 11 Drawing Sheets

Figure 1:
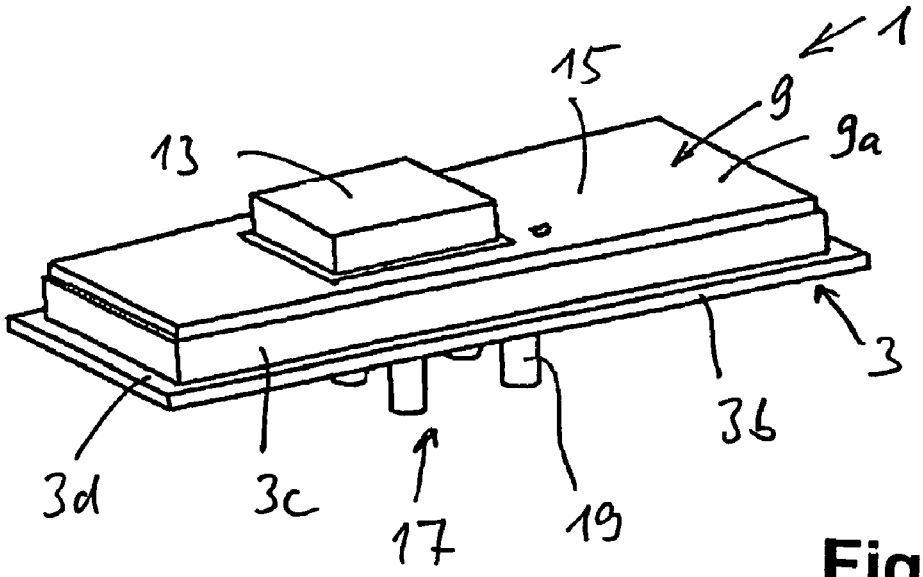

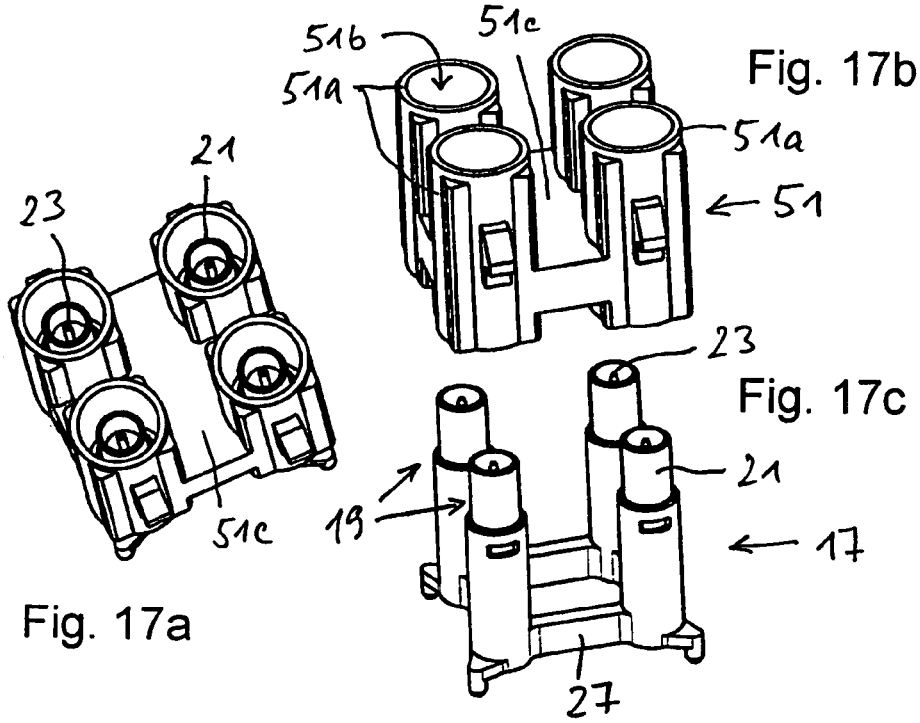
Fig. 17b
Fig. 17c
Fig. 17a
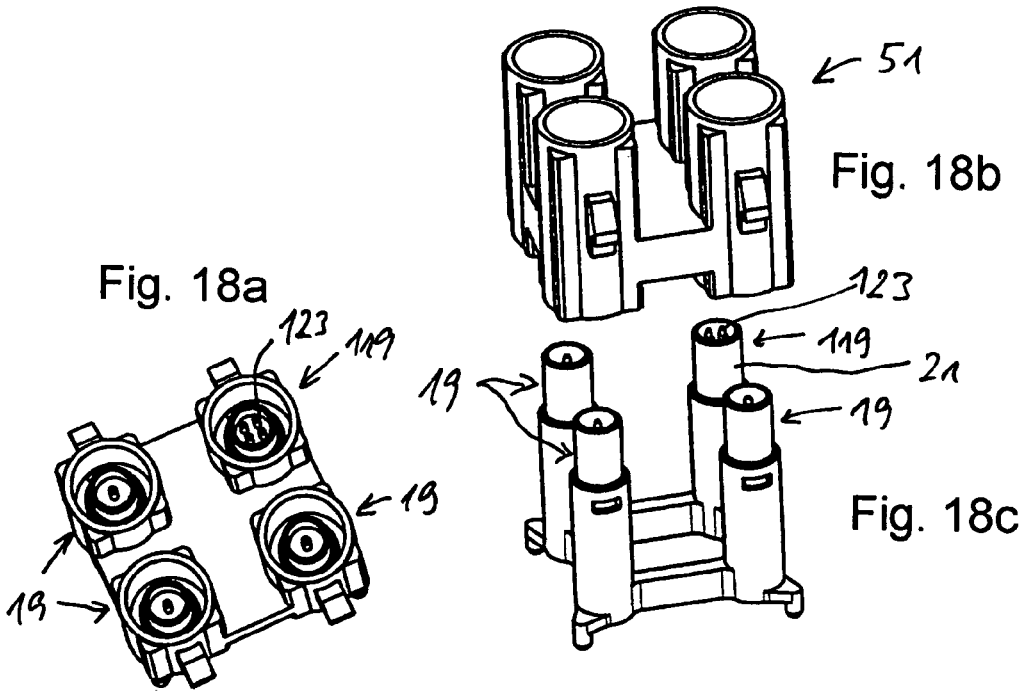
Fig. 18b
Fig. 18a
Fig. 18c

Fig. 19b
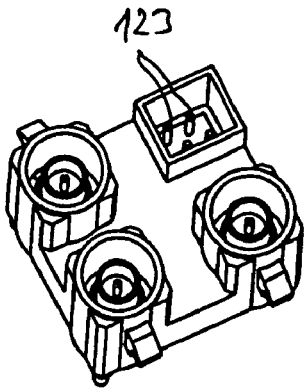
Fig. 19a
Fig. 19d
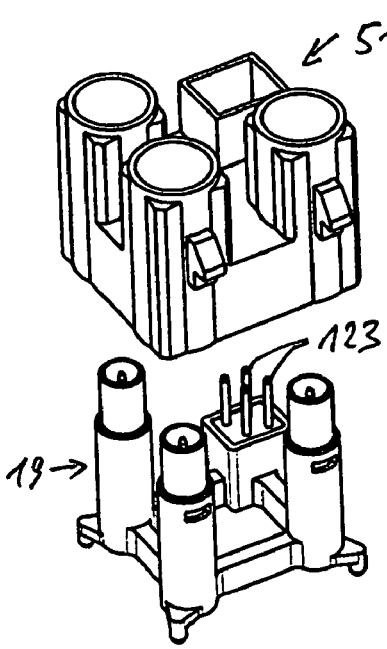
Fig. 19c
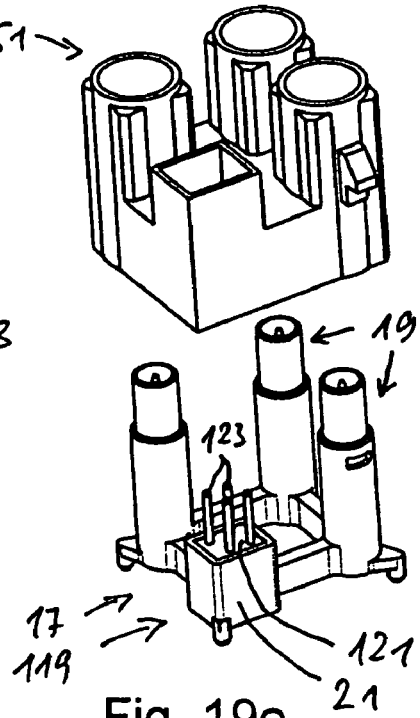
Fig. 19e
Fig. 20b
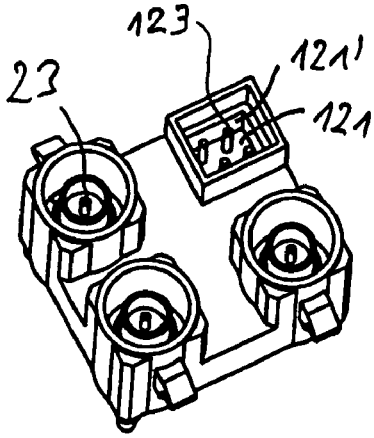
Fig. 20a
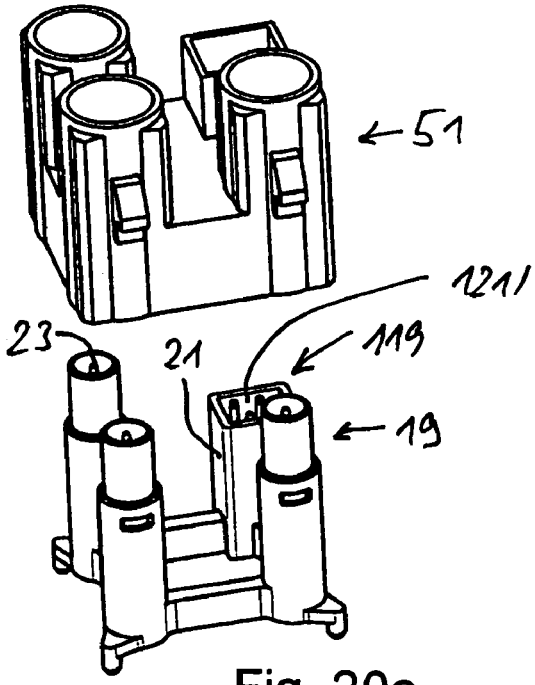
Fig. 20c Fig. 21b
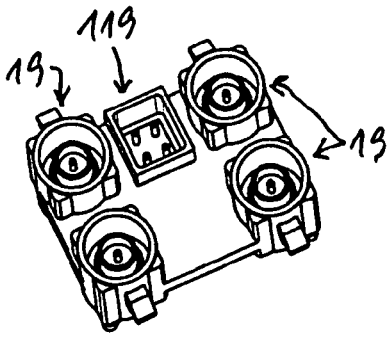
Fig. 21a
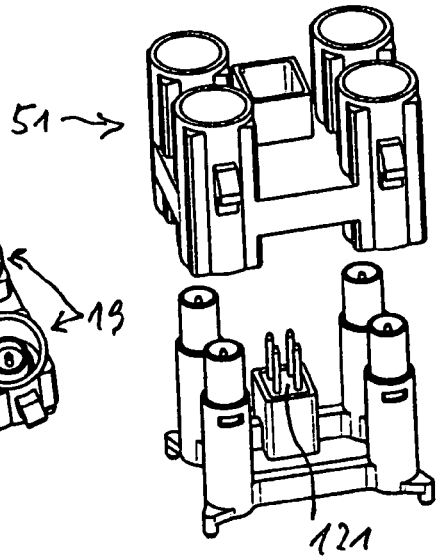
Fig. 21c
Fig. 21e
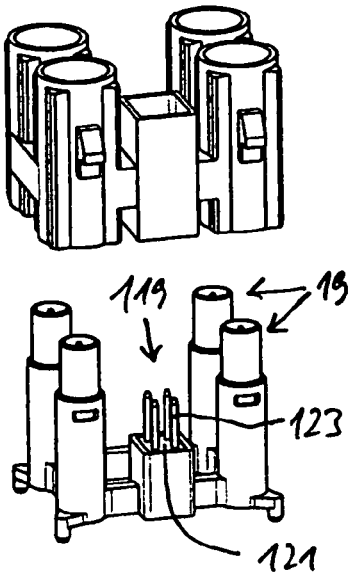
Fig. 21d
Fig. 22b
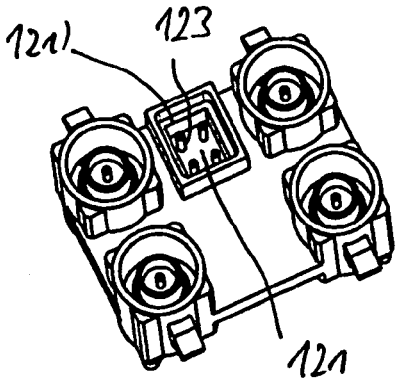
Fig. 22a
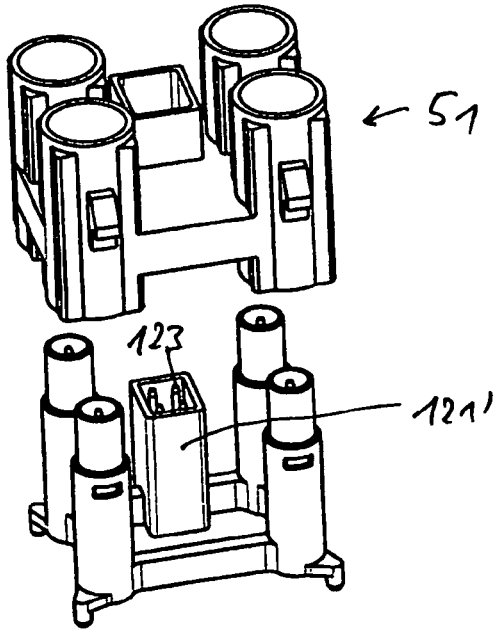
Fig. 22c

COAXIAL RF CONNECTION DEVICE ELECTRICALLY CONNECTED TO A PRINTED CIRCUIT BOARD AS WELL AS ASSOCIATED CONNECTOR UNIT

The invention relates to a coaxial RF connection device electrically connected to a printed circuit board according to the preamble of claim 1 as well as an associated connector unit.

Vehicle roof antennas are frequently used today, particularly in automotive technology, which for example are suitable for receiving one or several mobile communication frequencies on the one hand and for receiving radio programs on the other hand. Furthermore receiver systems are also normally incorporated in these vehicle roof antennas for determining the vehicle position, which according to the current standard consist of so-called GPS receivers.

Such vehicle antennas are usually embedded in antenna housings mountable on the vehicle, which comprise an antenna hood, fitted to a corresponding understructure. Normally parallel with this a printed circuit board, on which the individual antenna elements are then positioned and electrically connected, is incorporated on the understructure.

Usually the vehicle antenna can be fitted and anchored in a suitable place by means of suitable mechanical retaining elements, which can be installed from underneath, that is to say from the vehicle interior. In addition it is usual in this case to feed a corresponding cable harness through an opening provided and connect this in the vicinity of the printed circuit board. Usually at least one cable, frequently a coaxial cable, is provided for each antenna.

In order to reduce assembly and cabling time and effort, vehicle roof antennas have also become known, in which the antenna housing contains a corresponding number of coaxial connectors, whereby a corresponding number of further connectors, which are provided at the end on a cable harness can be contacted on the interface formed in this way.

In accordance with the generic-creating German Patent DE 20 2005 004 658 U1 it has already been proposed that a corresponding number of so-called first coaxial connectors are fixed in a so-called mating interface on the antenna housing and also that second coaxial connectors are provided, which are held on a further connector part, so that both connectors, can be mated together producing an electrical connection for all coaxial cables.

Since natural tolerance problems arise and the mating together of two or several coaxial connectors would always throw up problems in accordance with the generic-creating DE 20 2005 004 658 U1, it has been proposed that the connectors held and positioned on the so-called mating interface are fitted and positioned in a flexibly sprung way, and to be precise with the aid of flexible spring elements. These are formed and arranged in such a way that the second coaxial connectors are initially positioned at the respective pre-determined position up to tolerance deviations and can be moved out from this point in a flexibly sprung way in the plane perpendicular to the mating direction.

Finally multiple coaxial connectors have also become known, for example dual coaxial connectors, which represent a solid modular unit. They have connection pins, by means of which their outer contact can be electrically and mechanically bonded to a printed circuit board. Such a known dual connector can be fitted to a printed circuit board as SMD component with the pin-in-paste process. Said pins to be mechanically and electrically bonded to the printed circuit board in the case of the known multiple coaxial connectors are aligned perpendicularly to the axial direction of the coaxial connectors, so that the coaxial connectors finally lie parallel with the plane of the printed circuit board.

The object of the present invention is to create a mating system for a coaxial connection device, improved in comparison to the above.

The object is solved in accordance with the invention as regards the connection device according to the features indicated in claim 1 or as regards the connector unit in accordance with the features indicated in claim 34. Advantageous arrangements of the invention are indicated in the sub-claims.

The invention is basically designed and suitable for a so-called FAKRA connector system, particularly for roof antennas, by means of which for example up to four coaxial connectors can be mated with corresponding coaxial sockets or couplers. As a result of this so-called FAKRA connector system the radio frequency contact points can be precisely defined by the manufacturer in their relative position to one another, whereby a corresponding four-fold coupler with identical modular dimension can then be provided on the cabling harness, in order to be able on the interface formed in this way to fit the coupler on the connector without difficulty.

According to the invention a connector unit is improved, which comprises at least two and preferably a plurality of coaxial connectors, consisting of a one-piece or integrally, that is to say, at least firmly linked unit or fitted and connected to such a solid unit. The individual coaxial connectors mated with each other in this unit are aligned in this case axis-parallel with one another and positioned to one another in pre-definable modular dimensions with lateral spacing.

The connector unit according to the invention is characterized on the one hand in that the at least one projection and preferably a plurality of projections connected to the respective outer contact of a connector are arranged parallel with the axial alignment of the connectors, so that the entire connector unit finally lies perpendicularly to the plane of the printed circuit board.

As an important feature it is also proposed according to the invention that the connector unit on the printed circuit board, at least in sections, is provided with a free space on the side facing the printed circuit board, which is intended for routing and/or populating the printed circuit board.

This free space or these recesses are provided so that, for example, contact surfaces or shoulders are provided on the connector unit, by means of which the connector unit lies on the adjacent plane concerned of the printed circuit board. Sections, offset from these contact shoulders, are provided however with said recesses or free spaces, which are dimensioned so that, also in the vicinity of the housing connection or the support frame linking the individual connectors, sufficient free space is created in the plane of the printed circuit board, so that the printed circuit board can be populated there with corresponding components. A free space of at least 0.5 mm or for example 1 mm is frequently already sufficient.

Alternatively or additionally it can be proposed that the individual connectors are arranged in their parallel alignment laterally offset to one another so that sufficient free space for routing and/or populating the printed circuit board is created between them.

In addition preferably it is proposed that this connector unit not only ensures electrical bonding of the centre and outer contacts of the coaxial connectors with the corresponding connection points on the printed circuit board, but especially is also mechanically firmly bonded with the printed circuit board.

It has also proved to be a further positive factor in the context of the invention that it is possible with such an architecture to electrically bond the centre contacts on the side of the printed circuit board on which the connector unit is positioned. In other words the solution according to the invention means that the connector unit can be implemented as an SMD component. This allows economic assembly, for example in the context of a so-called reflow solder process.

A further important advantage, particularly in contrast to the prior art, is that as a result of this SMD component the RF conducting centre contact on the side facing the connector unit (this is also designated below sometimes as printed circuit board lower side or sometimes as second printed circuit board side) are shielded where they terminate, since namely the opposite printed circuit board side (this is also designated below sometimes as printed circuit board upper side or sometimes as first printed circuit board side) can for example be provided with a wide-area electrically conductive layer, a so-called potential- or earth-surface (which is again possibly covered by an insulating layer).

In contrast to this up until now it has been necessary with the prior art to feed the centre contacts through corresponding holes in the printed circuit board and contact these on the upper side of the printed circuit board carrying the antenna elements.

It has therefore been demonstrated in the context of the invention that as a result of the inventive architecture a substantial improvement in radio frequency decoupling (RF decoupling) is possible.

Good mechanical bonding of the connector unit can be achieved due to the fact that at least some coaxial connectors are provided with projections protruding in the mating direction or with a corresponding electrically conductive accessory with corresponding projections, these projections engaging into corresponding openings or holes in the printed circuit board, whereby preferably these openings or holes can also be plated through. The ends of these projections are electrically soldered with the printed circuit board, that is to say usually with the wide-area potential- or earth-surface formed there, as a result of which shielding is achieved. Therefore not only electrical earth-connection but solid mechanical bonding of the connector unit with the integrated coaxial connectors on the printed circuit board is ensured.

Since the RF centre contacts no longer protrude through holes provided in the printed circuit board as far as the printed circuit board upper side or rise above this printed circuit board upper side, but are soldered flush with the printed circuit board lower side by the reflow process, it is now even possible in the context of the invention to position, for example, a standard ceramic patch antenna above the connector unit, therefore in an area, in which on the opposite side of the printed circuit board, the ends of the centre contacts of the connectors would finally lie and be soldered there.

In a particularly economic and preferred solution in the context of the invention the connector unit can be implemented as a die-cast part, that is to say at least the earth-body constituting the substantial part of the connector unit, having corresponding axis-parallel recesses, in which, separated by a dielectric, the centre contacts of the connectors formed in this way are positioned.

In addition the earth-body itself can also consist of a plastic cage or plastic frame as a result of which the several connectors having fixed parallel alignment are positioned in a fixed predetermined axial distance to each other, in order to avoid tolerance problems. In this case corresponding contact pins, which can be used for contact with the printed circuit board for example on the individual coaxial connectors, can be formed or connected therewith.

In addition, however, finally further modifications are also possible, for example such that despite the use of a retention frame, consisting of non-conductive dielectric material, for the individual coaxial connectors, additionally an electrically conductive single metal plate is also used, by means of which the outer contacts of the individual connectors are preferably electrically bonded together. On this single metal plate the corresponding projections can preferably then be formed running perpendicularly to the printed circuit board plane, which can then be inserted into corresponding holes or openings in the printed circuit board and soldered with the side opposite the connector unit preferably on the printed circuit board and the earth-surface preferably formed there.

The connector unit can be constructed so that it comprises several plugs, or also alternatively, as a so-called "female part" it only consists of sockets. However it is also equally possible that the connector sometimes has plugs and sometimes sockets, which can be mated together with a corresponding opposite part.

Furthermore the connector unit according to the invention however can also represent a combination of single-pole or multi-pole shielded and unshielded connectors. The inventive connector unit therefore as a result preferably comprises at least two shielded coaxial connectors and also for example at least one further single-pole or multi-pole unshielded connector or for example at least one further two-pole or multi-pole shielded connector.

Particularly the additional two-pole or multi-pole shielded cables can be used for example to supply current or for other telematic services such as central vehicle locking etc. In addition, with other more demanding or more complex services, which are more prone to interference as a result of extraneous frequencies however, there may also be a need for shielding this signal cable.

Figure 2:
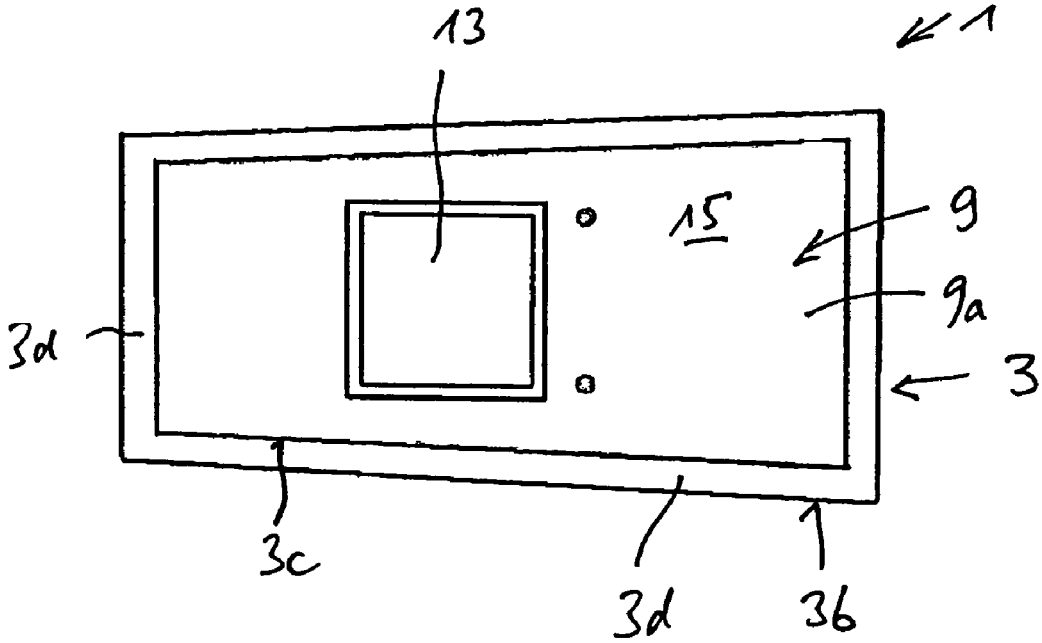
Figure 3:
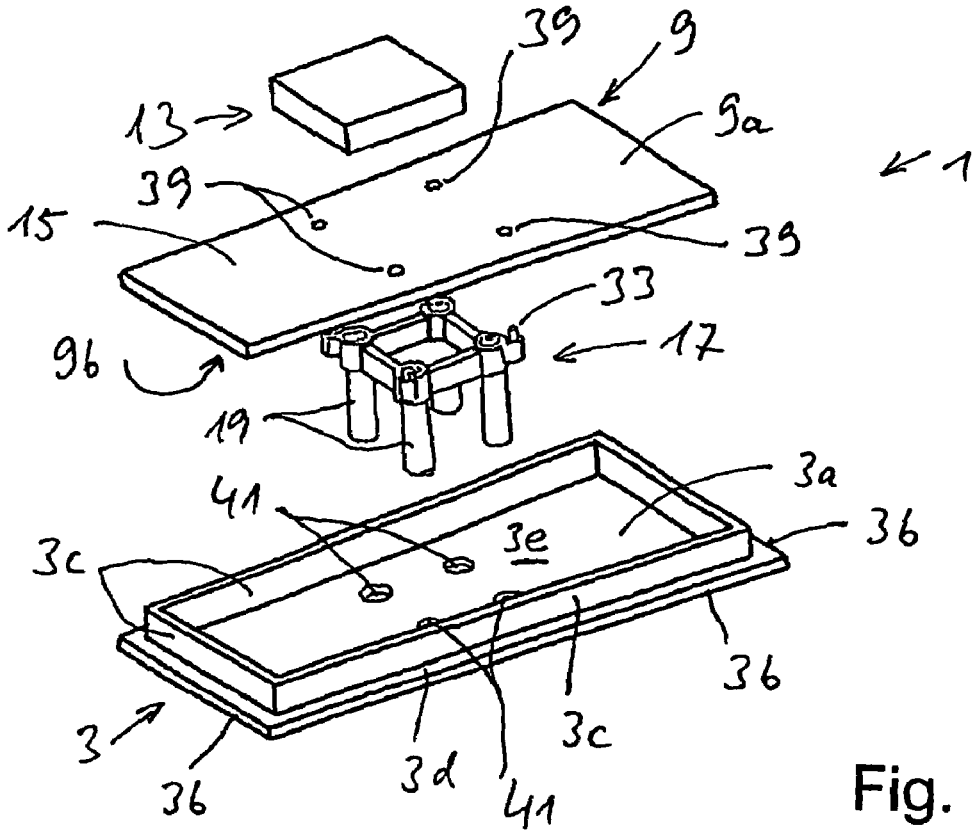
Figure 10:
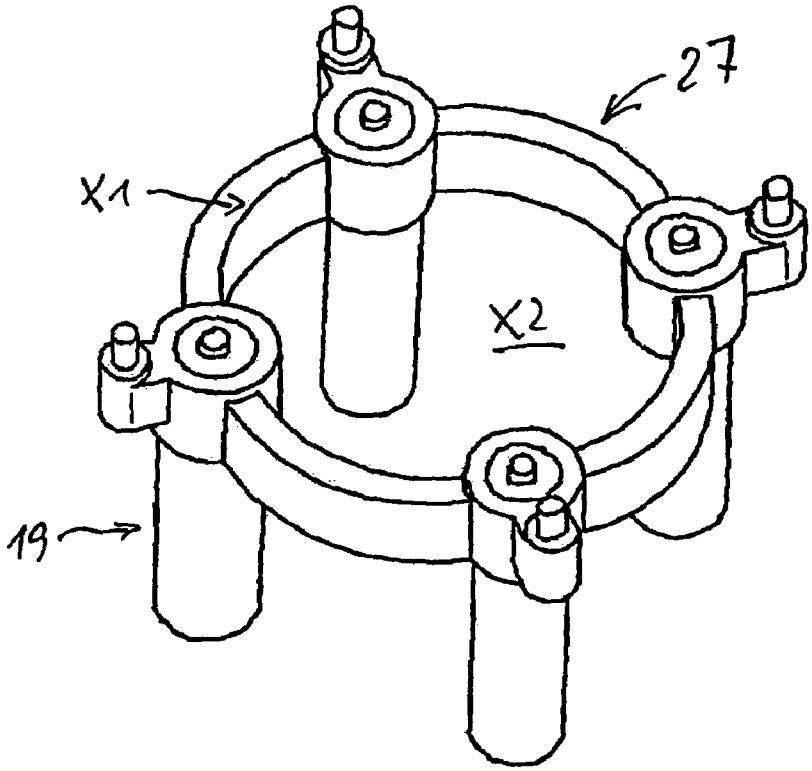
Figure 4:
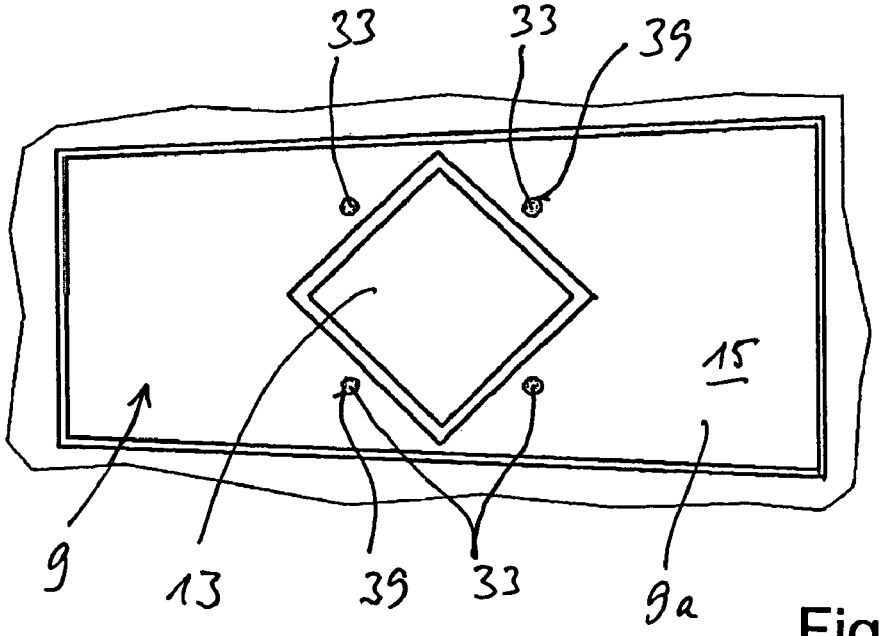
Figure 5:
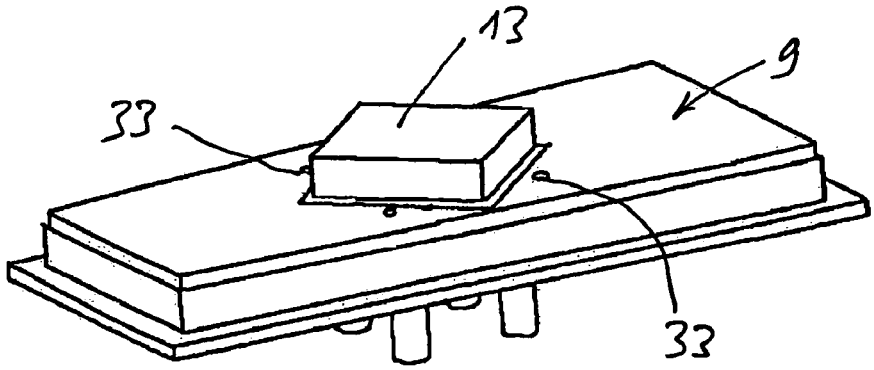
Figure 6:
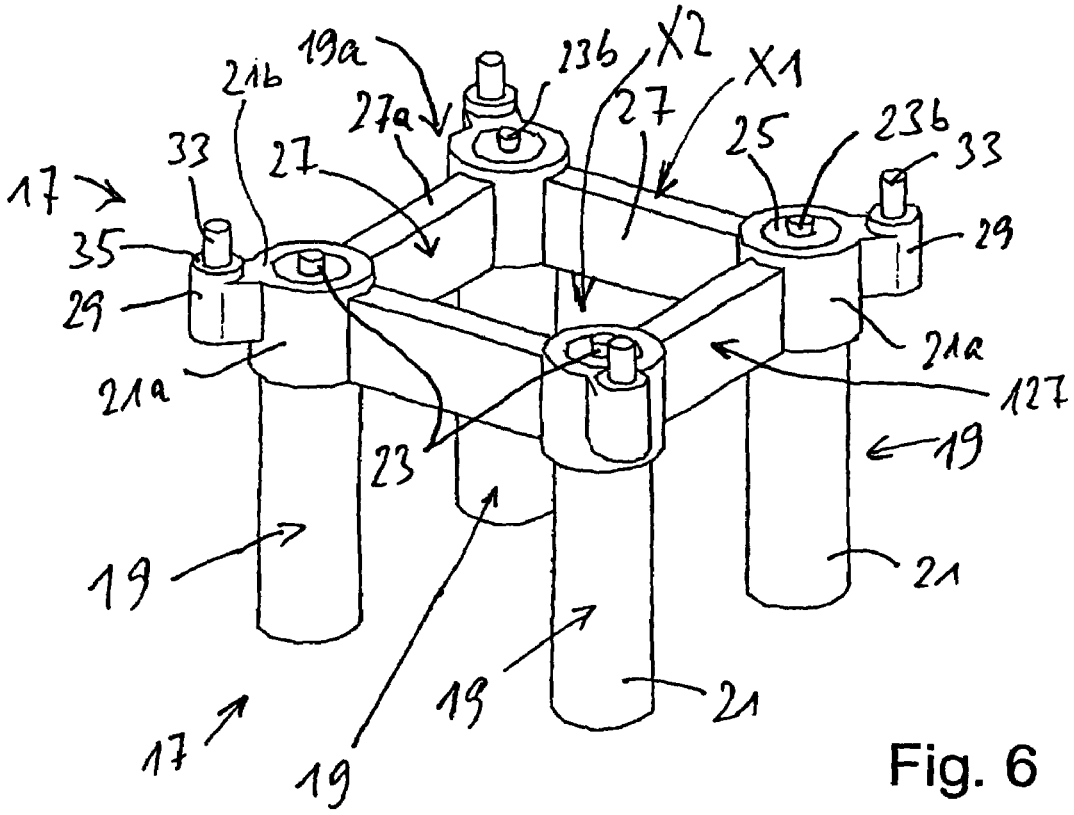
Figure 7:
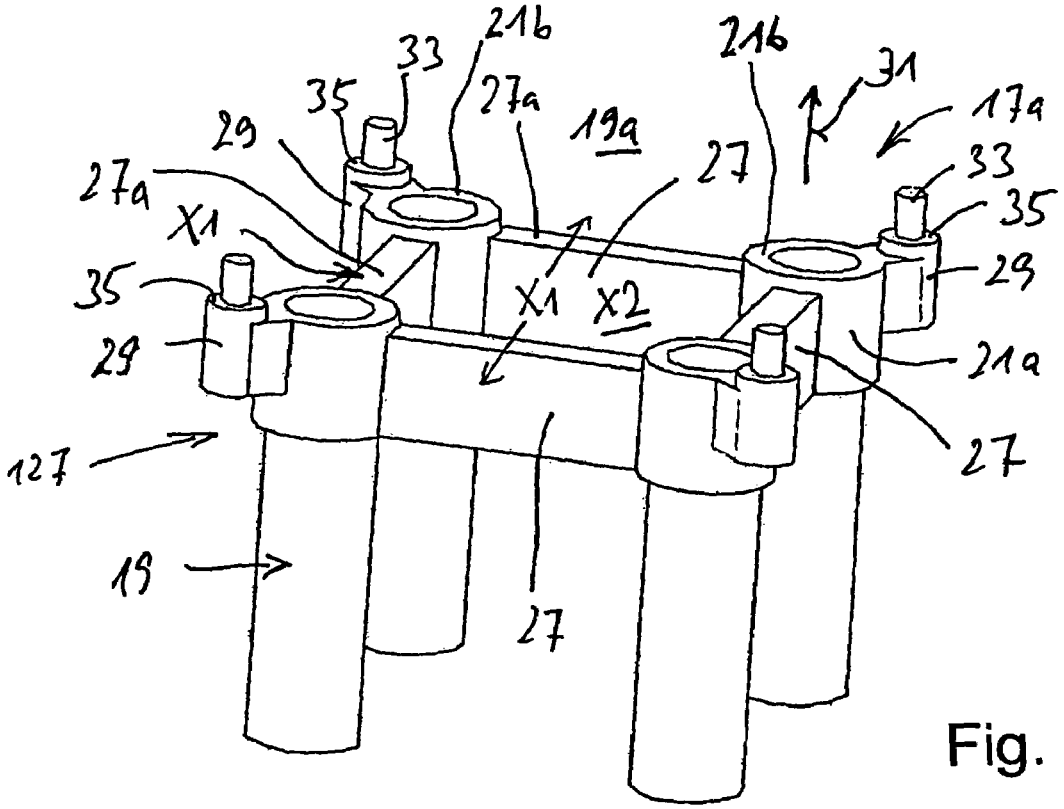
Figure 8:
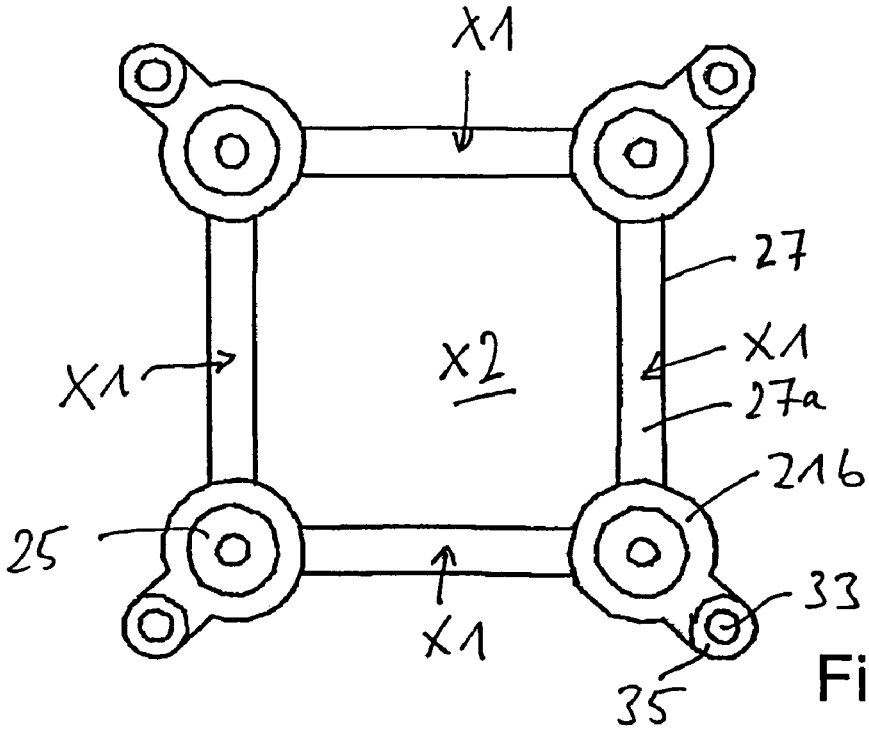
Figure 9:
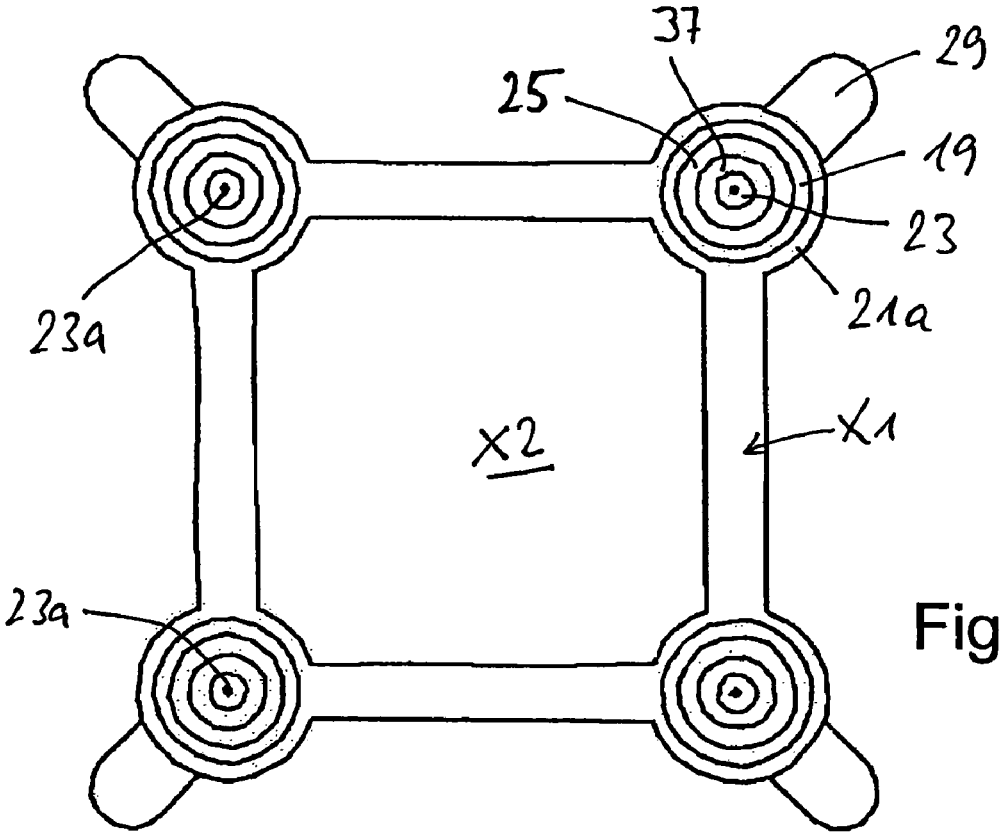
Figure 11:
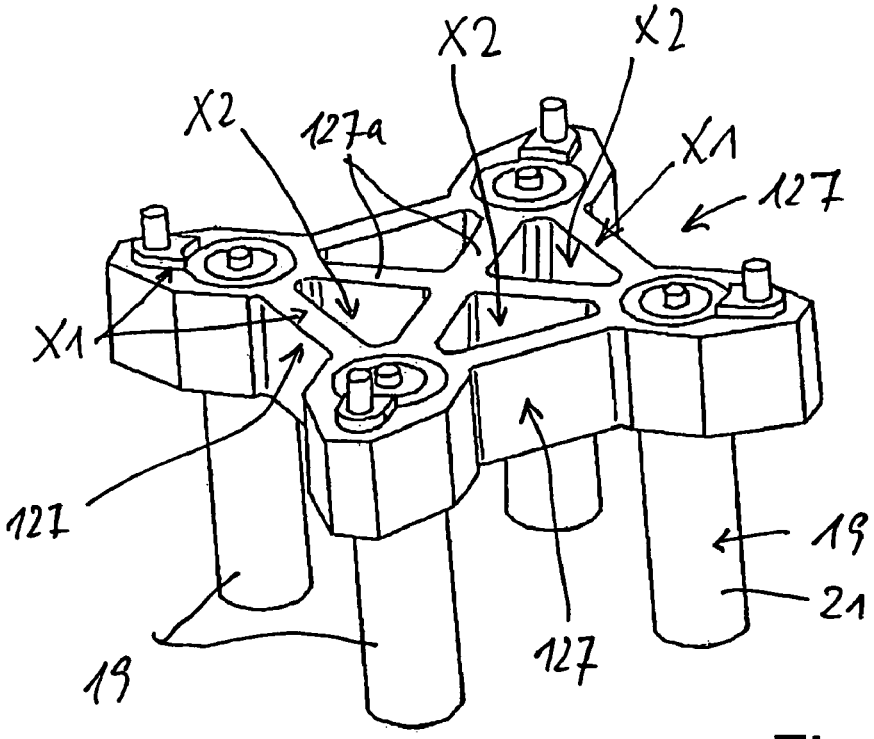
Figure 12:
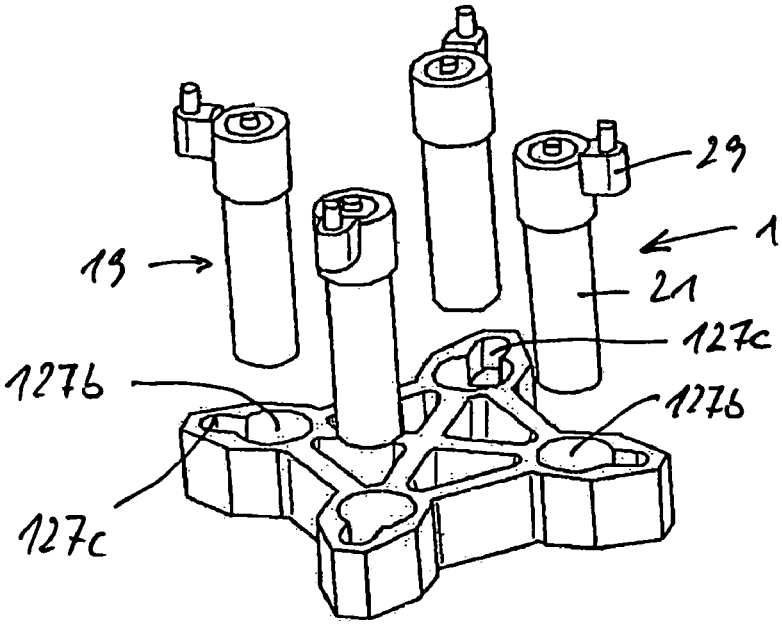
Figure 13:
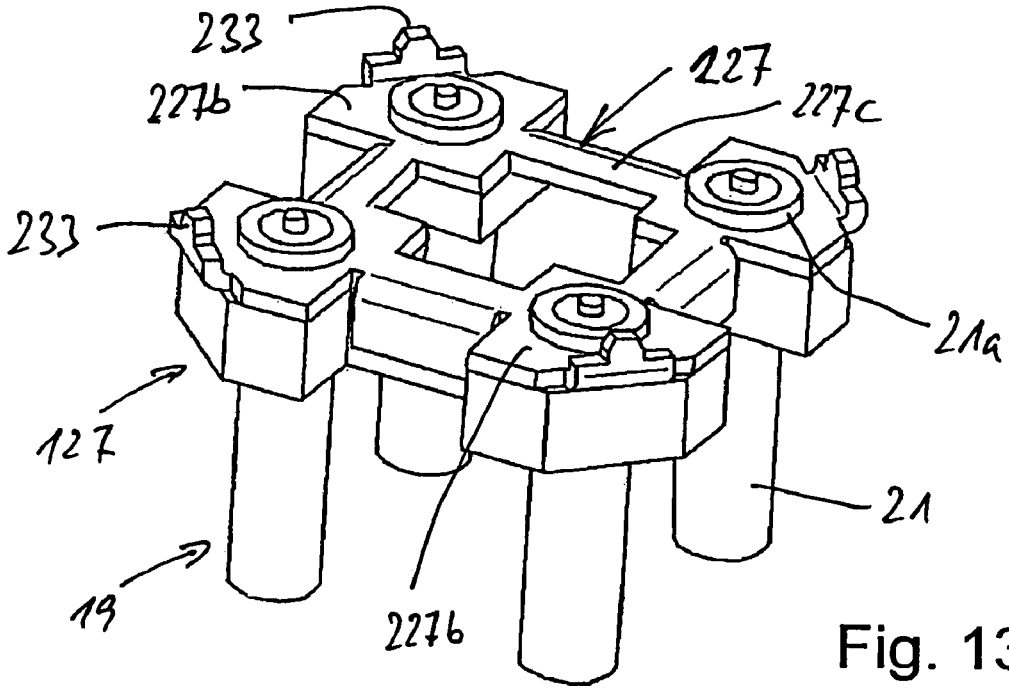
Figure 14:
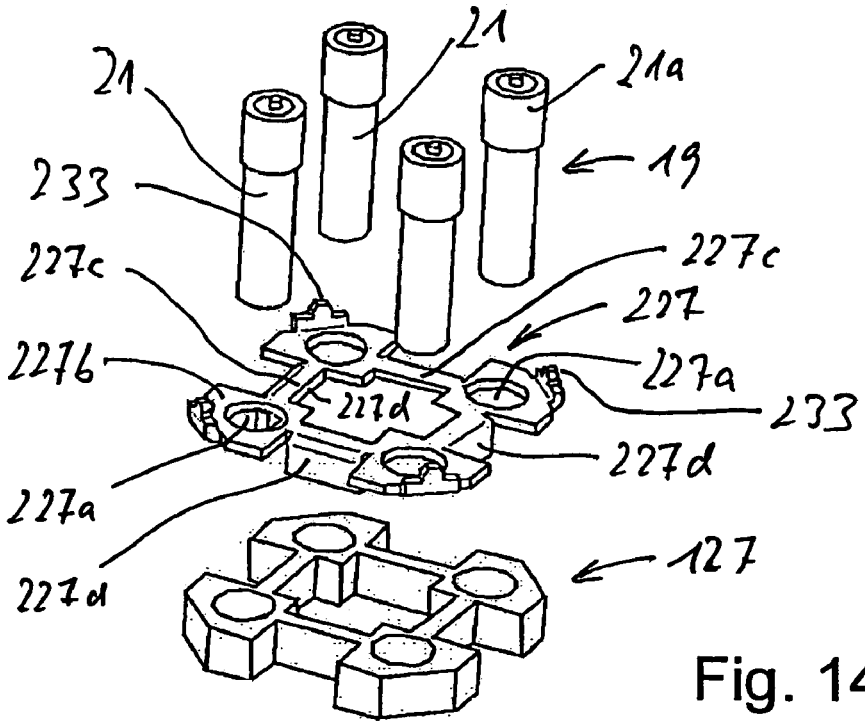
Figure 15:
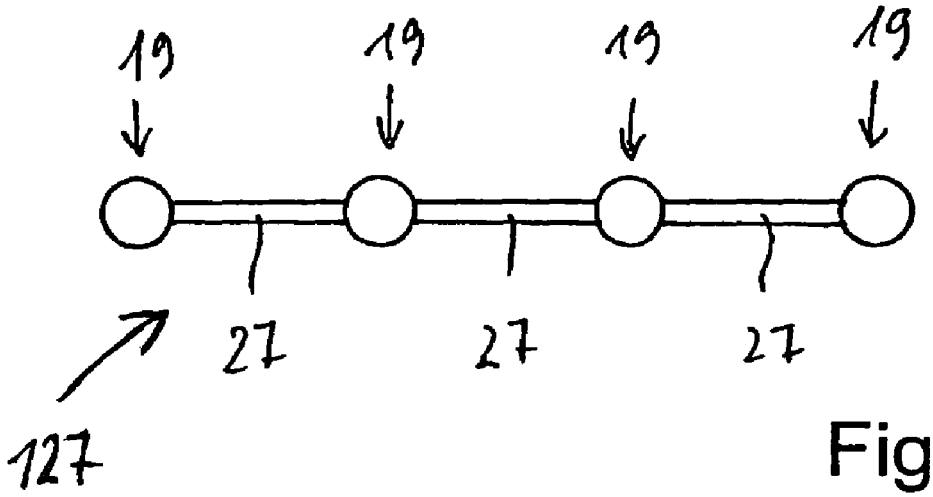
Figure 16:
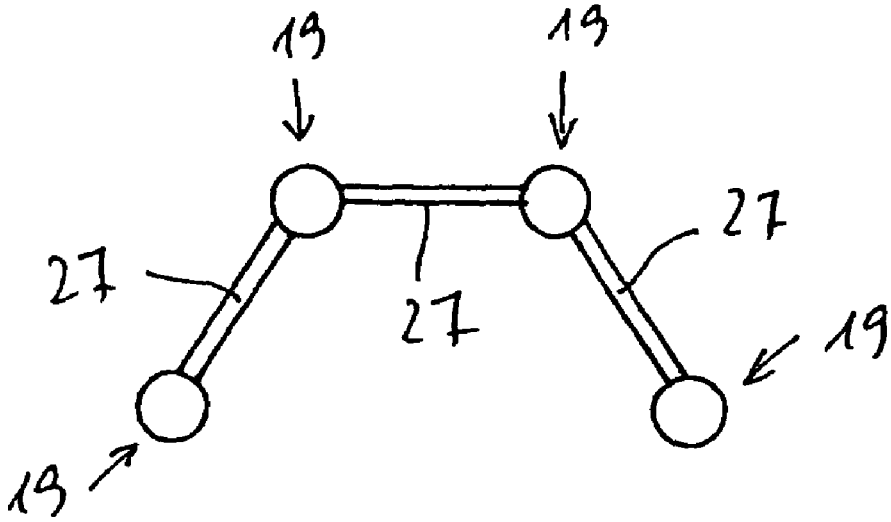

Further details, features and advantages of the invention are evident from the exemplary embodiments discussed below. There are shown in detail:

FIG. 1: a schematic three-dimensional illustration of a first exemplary embodiment of a vehicle antenna with an understructure, a printed circuit board, a patch antenna and a connector unit protruding over the base on the lower side;

FIG. 2: a plan view onto the exemplary embodiment in accordance with FIG. 1;

FIG. 3: an illustration corresponding to FIG. 1; however with an exploded view of the main parts, FIG. 4: a plan view onto a vehicle antenna comparable with the plan view of FIG. 2, however with an arrangement of a patch antenna deviating therefrom;

FIG. 5: a three-dimensional illustration corresponding to FIG. 4 comparable with the exemplary embodiment according to FIG. 1;

FIG. 6: a three-dimensional illustration of a first exemplary embodiment of the connector unit according to the invention, forming four axis-parallel coaxial connectors;

FIG. 7: an illustration comparable with FIG. 6, however only reproducing the electrically conductive connector housing without centre contacts assigned therein using corresponding dielectrics;

FIG. 8: a plan view onto the exemplary embodiment according to FIG. 6;

FIG. 9: a view of the opposite side onto the connector unit in accordance with FIG. 6;

FIG. 10: an exemplary embodiment of a connector unit with differently configured connecting bridges, modified compared with FIG. 6;

FIG. 11: a modified exemplary embodiment of an inventive connector unit with a retaining and fixing frame for four axis-parallel coaxial connectors;

FIG. 12: an exploded view of the exemplary embodiment according to FIG. 11;

FIG. 13: an exemplary embodiment, again modified compared with the preceding figures, with retaining and fixing frame for the coaxial connectors from non-conductive (dielectric) material and an additional, metal plate electrically connecting the outer contacts of the connectors;

FIG. 14: an exploded view of the exemplary embodiment according to FIG. 13;

FIG. 15: a schematic plan view onto a modified exemplary embodiment of a connector unit, whose coaxial connectors are arranged in plan view next to one another along a line at a distance from each other;

FIG. 16: an exemplary embodiment again modified compared with FIG. 15, in which the connecting device comprising the connecting bridges is openly formed, whereby not all central axes of the connectors lie in one plane;

FIGS. 17*a* to 17*c* a three-dimensional plan view onto a connector unit comprising four coaxial connectors provided with an additional housing as protective function, and also said housing in a three-dimensional separate illustration and the connector unit with housing removed;

FIGS. 18*a* to 18*c* an exemplary embodiment comparable with FIGS. 17*a*-17*c*, in which however in place of a coaxial connector 19 a shielded connector is provided with four centre contacts;

FIGS. 19*a* to 19*e* a three-dimensional plan view onto a modified exemplary embodiment, in which in place of a coaxial shielded connector a four-pole unshielded connector is formed on the connector unit, as well as two illustrations rotated by 180° in relation to the removed housing as well as the connector unit shown without housing;

FIGS. 20*a* to 20*c* an exemplary embodiment modified in relation to FIGS. 19*a*-19*e* so far as a shielded connection for a four-pole connector is provided here;

FIGS. 21*a* to 21*e* an exemplary embodiment modified compared with FIGS. 19*a*-19*e*, in which sitting on four corners of the connector unit, four shielded coaxial connectors are provided and an additional unshielded multi-pole connector is arranged between two coaxial connectors, and FIGS. 22*a* to 22*c* an exemplary embodiment modified compared with FIGS. 21*a*-21*e*, in which the additionally provided multi-pole connector is formed as shielded connector.

Firstly reference is made below to the exemplary embodiment in accordance with FIGS. 1-3.

In this exemplary embodiment an antenna 1, particularly a vehicle antenna 1 is shown, as it can normally be fitted to a vehicle roof, frequently directly adjacent the upper edge of the rear window.

This antenna 1 comprises an understructure 3, also recognizable in the exploded view in accordance with FIG. 3, which usually consists of metal. The understructure has a base 3*a*, on which at the inwardly offset outer edge 3*b*, in the exemplary embodiment shown, a bridge 3*c* is formed orbiting and extending crosswise or perpendicularly to the plane of the base 3*a* leaving behind an edge strip 3*d*.

The understructure or chassis 3 can consist of suitable material. Usually for this purpose a die-casting is used, for example a zinc die-cast part. A protective hood permeable to electromagnetic rays is fitted to the understructure formed in this way, which protects the electrical circuits including the antenna elements, the printed circuit board and the connections concerned located underneath against the outside. For better illustration this protective hood, which can be designed arbitrarily with wide tolerances, was not included in the drawings.

A printed circuit board 9 can be positioned or anchored on this bridge or inside the bridge 3*c* in the inner space formed in this way (for example by driving in fixing screws in a suitable place, which can be screwed with their thread into corresponding counter support devices on the understructure 3).

The printed circuit board has a first side or upper side 9*a* and a second or lower side 9*b*.

On the first or upper side 9*a* several different emitter- or antenna-devices are normally provided. In the exemplary embodiment shown only a patch-type antenna 13 is illustrated, which for example is configured as a square in plan view and is normally used as an antenna device for receiving satellite signals. The other antennas on the printed circuit board 9 are not illustrated. Arbitrary antenna architectures are possible.

The first or upper side 9*a* of the printed circuit board 9 can be covered over a wide area with an electrically conductive earth- or potential-surface 15, which is possibly again overcoated with an insulating plastic layer. This insulating layer—not illustrated in detail in the drawing—over the earth- or potential-surface 15 can be removed or omitted in suitable places where soldering is to be carried out.

Finally in FIGS. 1-3 a connector unit 17, positioned on the printed circuit board lower side 9*b* is to be seen, which, in the exemplary embodiment shown, comprises four axis-parallel coaxial connectors 19.

Before the further architecture of the antenna formed in this way and the connector unit is discussed, on the basis of FIGS. 4 and 5 it is described beforehand that for example said patch antenna 13 can also be positioned on the printed circuit board 9 in an arrangement rotated by 45° (or any other arbitrary angle) in relation to the exemplary embodiment according to FIGS. 1-3, so that the diagonals of the patch antenna, square in plan view, therefore run parallel with the lengthwise and transverse direction of the understructure 3 of the antenna 1 formed in this way.

Normally further emitters and antenna devices are arranged on the printed circuit board 9, in the exemplary embodiment shown, usually another three antenna devices or antenna elements on the printed circuit board, so that four separate signals from four services can be sent and received via four coaxial connectors.

Reference is made below to FIG. 6, in which a connector unit 17 according to the invention, as used in the exemplary embodiment according to FIGS. 1-5, is now illustrated in three dimensions.

This exemplary embodiment concerns a connector unit 17, each of the four connectors 19 running axis-parallel with one another, having an outer contact 21, a centre contact 23 and a dielectric 25, which is arranged between the centre and outer contacts at least over a partial length of the connectors 19 formed in this way.

The four connectors 19, in the exemplary embodiment shown, are arranged spatially to one another with a fixed predetermined modular dimension. In the exemplary embodiment shown, for this purpose the axes of the RF contacts lie in the corners of a square with a predetermined edge length, for example according to the standard specifications of the so-called FAKRA connector system.

For the purpose of creating a uniformly manageable connector unit the outer contacts 21 of the four connectors 19 are linked with connecting bridges 27. In the exemplary embodiment shown these connecting bridges 27 extend perpendicularly to the parallel axes of the individual connectors 19. In the exemplary embodiment shown the connecting bridges 27 are not provided or formed over the entire axial length of the connectors 19, but only over a partial length and preferably on the printed circuit board contact side 19*a* lying at the top side in FIG. 6. The connecting bridges 27 in this case engage into an outer contact section 21*a* on the respective outer contact of the connectors 19, which have a greater outer contact diameter in relation to the rest of the outer contact diameter.

In FIG. 7 there is shown in this case an illustration, comparable with FIG. 6, of a so-called connector housing 17*a*, which comprises in detail the outer contacts 21, the connecting bridges 27 linked therewith and the earth-connecting shoulders 29 yet to be discussed below, therefore without the centre contacts inserted in the outer contact 21, which are held by respective said dielectric 25 opposite the associated outer contact 21.

As also evident inter alia from FIGS. 6 and 7, the top side 27*a* of the connecting bridges, facing the printed circuit board contact side 19*a*, is formed so as to lie deeper in relation to the front boundary plane 21*b* of the outer contacts 21, so that as a result a free space X1 is created under the printed circuit board for routing and populating this with components.

In the exemplary embodiment shown, in each case pointing outwards in the diagonal direction (therefore at a 135° angle to the longitudinal direction of the connecting bridge 27) an earth-connecting shoulder 29 projecting outwards is provided, which in the exemplary embodiment shown is always constructed with a projection protruding in the mating or connecting direction 31 (FIG. 7) and therefore perpendicularly to the projection protruding from the printed circuit board, that is to say pin or peg 33 or is formed therewith. The peg or pin 33 has a diameter, which is smaller than the thickness dimension, parallel thereto, of the earth-connecting shoulder 29 holding the peg or pin 33. As a result a bearing surface or boundary plane 35, circular in the exemplary embodiment shown, is created.

It is also evident from the drawings that these pins 33 serving the earth-connection rise up from a boundary plane 35, whose level once again lies higher by a slight step than the front boundary surface 21*b* of the outer contacts 21 of the connectors 19. As a result the free space X1 between the top side 27*a* of the connecting bridges 27 and the printed circuit board 19 lying adjacent (in the final assembled position) corresponds to the distance between the top side 27*a* and the boundary plane 35 on the earth-connecting shoulders 29. If this free space amounts for example to more than 0.5 mm, particularly 1 mm, or possibly also 1.5 or 2 mm and more, then assembly on the printed circuit board can be carried out here in this free space X1 without difficulty. With the present size of component parts frequently a free space of 0.5 mm or 1 mm is already sufficient.

Finally it is to be noted for the sake of completeness that the top sides 21*b*, deviating from the illustration in FIGS. 6 and 7, at least in a partial circumferential area, can also be provided with radial recesses interspersing the material wall, which are dimensioned at least so deeply that the groove-shaped recess terminates at the height of the top side 27*a* of the connecting bridges 27. These recesses can also be used for routing, that is to say for connecting the centre contacts. As a result the outer contact 19 or the outer contact sections 21*a* in this area finally lie at a somewhat greater distance to a connecting cable running on the adjacent lower side of the printed circuit board, by means of which an associated centre contact of the connector 19 is connected.

Finally the exemplary embodiment according to FIGS. 6 and 7 also shows that a further free space X2 is created between the coaxial connectors 19 as a result of the orbiting retaining frame, comprising the connecting bridges 27 lying in the centre, so that even larger SMD parts can easily be assembled on the printed circuit board without colliding with this multiple coaxial connector (see FIGS. 6 and 7).

Preferably the connector unit formed in this way (FIG. 7) comprises the outer contacts 21 of the connectors 19 as well as the connecting bridges 27 and the outer contact sections 21*a*, having a greater diameter, as well as the earth-connecting shoulders 29 and the pins or pegs 33 projecting therefrom, which form an electrically conductive connector housing 17*a* with a connecting frame or connecting device 127 comprising the connecting bridges 27. This unit can preferably be produced using electrically conductive material such as die-casting with a conductive and solderable surface, for example in the form of a zinc die-cast part.

In FIG. 8 the plan view onto the connector unit 17 is evident from the printed circuit board connection side and in FIG. 9 from the opposite lower side. The ends, evident here, of the centre contacts 23 usually terminate so as to taper conically, as a result of which the centre contact tips 23*a* are visible in FIG. 9. A free space 37 is then formed adjacent the centre contacts, in order to be able to insert an opposite coupler part here.

The connector housing formed in this way, which is additionally provided with the centre contacts 23 and a respective dielectric 25 supporting the centre contacts 23 can then be assembled on the printed circuit board 9 as an SMD component. The connector unit 17 for example is assembled as multiple connector on the printed circuit board lower side 9*b* with the pin-in-paste process, whereby said pins or pegs 33 are inserted into corresponding plated through recesses 39 (holes) and soldered with the printed circuit board 9 (FIGS. 1-5). The dimensions are therefore selected so that the axial length of the pins or pegs 33 extends at least up to the proximity of the plane of the upper side of the printed circuit board 9 in the assembled state.

In this position the circular contact or boundary surface 35 of the earth-connecting shoulders 29 abuts against the lower surface 9*b* of the printed circuit board 9. The ends 23*b* of the centre contacts 23, which are soldered on the printed circuit board lower side 9*b*, for example by a reflow soldering process, at corresponding solder points on the printed circuit board, also terminate in this plane or approximately in this plane.

The printed circuit board lower side 9*b* in this case also has cable connections formed accordingly and as populating side is also usually provided with further electrical components, which for the sake of simplicity are not illustrated in detail on the drawings.

As a result of the overall electrically conductive architecture of the one-piece connector housing of the connector unit 17, by means of the pins or pegs 33 of the earth-connecting shoulders 29, not only electrical, but also mechanically solid bonding with the printed circuit board is ensured.

The printed circuit board, as illustrated in FIGS. 1-5, can then be assembled on the understructure 3 of the antenna 1, whereby the cylindrical connectors 19 are then pushed through corresponding holes 41 (FIG. 3) in the base 3*a*. In this case the diameter of the holes 41 is usually greater than the outside diameter of the connectors 19, so that there is no contact between the connectors and the base here. As a result of the pins or pegs 33 mechanically anchored and electrically connected in the printed circuit board 9 however, the connector 19 formed in this way is also mechanically firmly bonded with the understructure 3 by means of the printed circuit board.

In the final assembled state the cylindrical connectors then rise sufficiently far above the plane of the understructure, so that an opposite coupler part can be mounted here, whose coupling sections finally lie at the same axial dimension as the central axes of the connectors 17.

Since, in the exemplary embodiment shown, the centre contacts terminate and are soldered on the printed circuit board lower side and are formed on the printed circuit board upper side preferably over wide area earth-surfaces, optimum shielding of the RF signals fed to the centre contacts is achieved. The wide-area earth-surfaces on the printed circuit board upper side are usually only provided with recesses, where for example further antennas—not shown in detail—are mechanically anchored or electrically connected, their signals then being relayed by corresponding through platings to the printed circuit board lower side.

Since especially the centre contact ends 23*b* terminate on the printed circuit board lower side 9*b* and do not protrude onto the opposite upper side, exactly at this point even a patch antenna 13 can be now be provided on the printed circuit board upper side 9*a*, since then these antennas will not collide or become electrically coupled with the centre contact ends 23*b*. Furthermore it can be ensured due to the arrangement, rotated by 45°, of the patch antenna 13 in accordance with the exemplary embodiment according to FIGS. 4 and 5, that in each case along the longitudinal side of this patch antenna arranged so as to be offset, the pins or pegs 33 are allowed to protrude through the corresponding holes or recesses 39 in the printed circuit board and can be soldered there, without colliding with the patch antenna.

In the case of the exemplary embodiment in accordance with FIGS. 1-3 the patch antenna is arranged in such a way that its square longitudinal sides run parallel with the longitudinal direction of the antenna array. In this case the patch antenna covers two pins or pegs 33 (which preferably terminate in the plane of the upper side of the printed circuit board), the two further ends of the pins or pegs 33, arranged so as to be offset, finally lying on the patch antenna adjacent the one crosswise running side. This arrangement in accordance with FIGS. 1 to 3 therefore offers the advantage that for example a ceramic patch antenna can be placed over the earth pins 33, wherein it must only be ensured that the earth-pins 33 do not protrude above the printed circuit board 9. This restriction is not the case with the embodiment in accordance with FIGS. 4-5, since there is sufficient space here for the earth-pins 33 due to the offset arrangement of the patch antenna.

Another embodiment is described on the basis of FIG. 10, in which the connecting bridges 27 have a different geometry. In this exemplary embodiment the connecting bridges, in plan view, each nearly correspond to a quarter circle. However other arbitrary modifications are also possible, for example cross-wise linking of the four connectors or an arrangement, in which the quarter-circle connecting bridges 27 shown in FIG. 9 do not point outwards with their convex-curved sides, but are aligned inwardly. Further arbitrary modifications are conceivable here.

On the basis of FIGS. 11 and 12 a further modification is shown in which the individual connectors 19 are implemented as combined milled or turned parts, and then linked to one another by a separate component, that is to say a connecting frame 127. This connecting frame 127 can also again consist of a milled or die-cast part, thus for example possibly being electrically conductive. In addition however it may also consist of a dielectric and thus non-conductive material, for example plastic.

So that the connecting frame 127 has sufficiently solidity and rigidity, in the exemplary embodiment shown, it is also provided with internal, cross-shaped or diagonally running reinforcement bridges 127*a*.

Said connectors 19, here formed separately, likewise again have the earth-connecting shoulder 29 (FIG. 12), already described in the preceding exemplary embodiments, which is mechanically and electrically firmly bonded to the respective outer contact 21. As a result positioning and mechanical connection with the printed circuit board, comparable with the preceding exemplary embodiments, as well as a corresponding electrical interface with the printed circuit board are ensured.

FIG. 12 shows, in an exploded view, how the plastic frame 127 is provided with corresponding cylindrical recesses 127*b* for the cylindrical connectors 19 and with a corresponding pocket-shaped extension 127*c* for seating the earth-connecting shoulders 29. This connecting frame 127 can be produced in any suitable way, for example also as a die-cast or milled part.

In the case of the exemplary embodiment in accordance with FIGS. 13 and 14, likewise a connecting frame 127 has again been used for mechanically mounting the four connectors 19. The connectors 19 however are not provided with separate earth-connecting shoulders 29 in this exemplary embodiment. The connectors by contrast are designed as rotationally symmetric parts, for example turned parts. In order to ensure outer contact bonding with the earth-surface on the printed circuit board here, in addition to the electrically non-conductive connecting frame 127 a separate, electrically conductive plate 227 is now used. This plate 227 has recesses 227*a*, which correspond concentrically to the central axes of the connectors 19, through which the outer contacts 21 or the outer contact sections 21*a*, having a greater outside diameter, are inserted and bonded mechanically/electrically with the plate 227. This plate 227 is otherwise also again arranged in the form of a frame, apart from the material sections 227*b* and the recesses 227*a* provided therein and the connecting bridges 227*c* linking these sections, having pairs of reinforcement sections 227*d* at a perpendicular angle thereto, by means of which the metal plate formed in this way can then be mounted on the connecting frame 127 consisting of plastic. The pins or peg-shaped projections 233, which are then again inserted through corresponding recesses of the printed circuit board and for example by the pin-in-paste process are mechanically/electrically bonded with the printed circuit board, are then formed on the external sections 227*a*.

The individual connectors 19 can be firmly connected to one another with the connecting frame 27, for example using a press fit. For this purpose for example the connectors 19 can be formed milled on a correspondingly orbiting section and/or the connecting frame is milled inside in the recess for seating the connectors, whereby the desired press fit can be implemented by pressing in. However equally the connectors 19 can also be extrusion-coated for example by means of plastic, in order to create a solid composite. There are no restrictions as regards any particular production methods or processes.

The different embodiments have been described for connectors 19 which are cylindrical or substantially cylindrically-shaped. In addition, the outer contacts may have other arbitrary cross-sectional shapes, for example an n-polygon cross section, square etc.

If an antenna is fitted to the vehicle with a connector unit, comprising in the corresponding exemplary embodiment four connectors, a corresponding coupler with a corresponding number of opposite connector parts can be easily mated and connected electrically thereto, from which the corresponding coaxial cables then run into the vehicle interior.

The connector explained above has been described in the form of a multiple connector. In place of a connector formed as a kind of female part, however, it is equally possible to use sockets in the form of a female part for this. In exactly the same way the multiple connector can also be formed so that for one part plugs and for the other part sockets are used. The opposite connector or coupler part, which can be mated together therewith would always have to be configured in the reverse accordingly.

On the basis of FIGS. 15 and 16 it is only shown in schematic plan view that said connecting frame 127, comprising connecting bridges 27, which with the outer contacts 21 of the coaxial link connector 19 can also represent a firmly connected unit or a component separated therefrom, must not necessarily be designed as an orbiting closed frame. In the schematic plan view in accordance with FIGS. 15 and 16 it is shown that this connecting frame or this connecting device 127 may run straight, can be configured with a curve-shape in plan view etc. Therefore a not-closed open chain-like connection between the individual coaxial connectors can also be provided, in which sufficient free space X1 and/or a further free space X2 can likewise be provided for routing and/or populating the printed circuit board.

The connector explained above can be produced in different sizes. Particularly with the exemplary embodiment according to FIGS. 6 and 7, however also for example with the exemplary embodiment according to FIG. 10 or according to FIGS. 14 and 15 the connecting bridges 27 each linking two adjacent coaxial connectors 19 are dimensioned in their length (and therefore as regards the lateral distance between two adjacent coaxial connectors) so that this length for example is greater than the outside diameter of the individual connectors 19 and smaller than three-times or four-times the diameter of the coaxial connectors 19. In the exemplary embodiment shown, this distance corresponds approximately to double the outside diameter of the individual connectors 19.

Finally it is also still noted in conclusion that the entire connector unit preferably can be provided with a coding. The coding may consist of the fact that an asymmetrical device or measure preventing rotational symmetry is provided, for example such that the cross section or the cross-sectional shape, at least of one coaxial connector 19, differs from the cross-sectional shape or cross section size of the other connectors 19, so that one plug can only be connected to another if they are clearly assigned to each other. This for example is also possible due to the fact that a projection is provided at least on one connector 19 lying outside in the mating area for example, and an opposite plug or coupler part has a corresponding recess at this point, not shown in detail on the drawings.

On the basis of FIGS. 17*a*-17*c* a RF connector device according to the invention is now shown three-dimensionally, that is to say in FIG. 17*a* in an embodiment comparable with the embodiments of FIGS. 6-12 or also FIGS. 13, 14, whereby another corresponding housing 51 made from electrically non-conductive material, preferably plastic, is mounted on the RF connector device formed in this way. In FIG. 17*b* here only the housing 51 is shown, whereby in FIG. 17*c* the corresponding connector unit 17 with the four shielded coaxial connectors 19 is shown without housing. In other words the housing 51 comprises corresponding housing sections 51*a*, however cylindrical in the exemplary embodiment, which in a protective manner surround the respective coaxial connectors 19 and which have an opening 51*b* lying on the top side, in order to join a coaxial connector here. The housing 51 is likewise formed in one piece and also covers the middle area with the connecting bridges 27 through a corresponding housing section 51*c*.

The connector unit explained above however must not necessarily—as discussed in the previous exemplary embodiments—be designed as a multiple coaxial connector. There are by all means applications, for example also in the case of a roof antenna, where the integrated services and/or non-rated voltage supply additionally also require single-pole or multi-pole unshielded connectors or for example also multi-pole shielded connectors or at least have advantages in this regard.

Thus for example, if the connector unit 17 is to be used in connection with a vehicle antenna, applications may be possible, in which for example some signals or currents fed into or emitted by the antenna (for example means of current supply) do not need complex coaxial transmission systems. Often a single-pole unshielded cable (for example for current supply) is sufficient. Telematic services, as for example central vehicle locking need two-pole or multi-pole, usually unshielded cables.

With other more complex and more demanding services or those prone to interference as the result of extraneous frequencies (for example concerning EMV radiation) there may be a need to shield the signal cable.

Therefore on the basis of the embodiment yet to be described below, it is shown that the connector unit 17 in the form of a compact SMD plug module, apart from the coaxial connectors 19, can also be provided with single-pole or multi-pole unshielded or also multi-pole shielded connectors. In this case the term "plug", often not differentiated in linguistic usage, should not only apply to the term "plug" in the restricted sense (male), but also to the application of a socket (female).

On the basis of FIGS. 18*a*-18*c* such a connector unit 17 is now shown, likewise again three-dimensionally as well as with the housing removed, in which deviating from the preceding exemplary embodiments, in place of one of the four coaxial connectors 19, a connector 19 with outer contacts 21 formed and dimensioned in a similar or comparable way is provided, in which however not one single-pole, but four separate cables 123 are incorporated in the centre. This therefore concerns a shielded four-pole connector.

Deviating from this number, two coaxial connectors and two further multi-pole shielded or unshielded connectors can also naturally be provided.

On the basis of FIGS. 19*a*-19*e* an exemplary embodiment is now shown, in which deviating from FIGS. 17*a*-17*d*, in place of a coaxial connector 19 in a corner of the connector unit 17 shown there, an unshielded connector with four centre contacts 123 is now shown. In this case the housing 51 also has a corresponding housing section 51*a* for this multi-pole connector 119, which in plan view is formed as a square or rectangle. Since this concerns an unshielded connection, the centre contacts 123 rise above a base section 121, which preferably is likewise electrically conductive and linked with the other connecting bridges 27 and with the other connectors 19 to form a solid connector unit 117. The ends of the multi-pole conductor 123 are shielded in the mating area by said housing section 51*a*, where a corresponding opposite connector can be mounted.

With the embodiment in accordance with FIGS. 20*a*-20*c* it is simply shown, deviating from the preceding exemplary embodiments, that an extension 121' protruding over the base section 121 is provided here, which in the exemplary embodiment shown is formed in cross section as an n-polygon or rectangle or square and forms part of the outer contact 21, whereby the extension 121' terminates at the height of the ends of the centre contacts 123. This therefore concerns a shielded multi-pole connector 119, whereby the housing is formed as in the exemplary embodiment according to FIGS. 19*a*-19*e*, and a corresponding square or rectangular housing section 51*a* surrounds this outer contact 21 having a rectangular or square cross section.

With the exemplary embodiment in accordance with FIGS. 21*a*-21*e* a connector with four shielded coaxial connectors 19 is shown, comparable with the preceding exemplary embodiment in accordance with FIGS. 6-14, whereby however the distance between two pairs of coaxial connectors 19 is greater in one direction than in the transverse direction. This allows the possibility of providing a multi-pole shielded or unshielded connector 119, lying in the centre for example.

With the exemplary embodiment in accordance with FIG. 21*a* a connection, square or rectangular in plan view, for a further multi-pole connector 119, is shown between two coaxial connectors, which in this exemplary embodiment is again formed as unshielded connection, in which the four centre contacts 123 shown rise above the base section 121 between two coaxial connectors. In this case the base section 121 is again provided with an extension 121' projecting towards the four centre contacts 123, which forms an outer contact 21, so that the extension 121' in the shape of the outer contact 21 is linked with the rest of the connecting bridges 27 to create a uniform connecting frame 127, which is electrically conductive.

On the basis of FIGS. 22*a*-22*c*, again comparable with the exemplary embodiment in FIGS. 20*a*-20*e*, it is shown that the base section 121 is extended as outer contact 21, with a rectangle or square cross section, and only terminates approximately at the height of the free ends of the centre contacts 123, in order for this multi-pole connection to be constructed here as shielded connection.

Said centre contacts 123 can be present in shielded and unshielded connectors in various numbers.

The invention claimed is:

1. Coaxial RF connection device, electrically connected to a printed circuit board, comprising:

a printed circuit board;

a coaxial multiple connection device comprising at least two coaxial connectors the at least two coaxial connectors being arranged axis-parallel with each other with a preset or pre-determined axis distance, further coaxial connectors connected to the at least two connectors and electrically connected to the printed circuit board, the at least two and the further connectors providing a connector unit firmly connected to one another and/or joined to a connector unit firmly connected to one another, the connector unit and/or the connectors joined solidly with the connector unit being mechanically firmly bonded to the printed circuit board, the center contacts of the coaxial connectors being electrically connected on the second side or lower side, facing the connector unit, of the printed circuit board, at least one projection electrically and mechanically firmly bonded with at least one outer contact of a connector, the projections engaging into recesses in the printed circuit board, as a result of which they are mechanically firmly anchored with the printed circuit board, the projections being aligned parallel with the axial direction of the connectors, by means of which the connector unit is positioned or can be positioned perpendicularly to the plane of the printed circuit board, the connector unit having, on a side facing the printed circuit board, devices forming a support surface and/or boundary plane, on which the adjacent plane of the printed circuit board lies on the connector unit, the connector unit having on the side facing the printed circuit board at least in sections a free space (X1), provided with at least one recess and/or recesses, which finally lie at a distance to the adjacent plane of the printed circuit board, the outer contacts of the connectors being arranged transversely offset to one another in such a way that a free space (X2) is formed between the connectors, the free space (X1) and/or the free space (X2) serve as room for routing and/or populating the printed circuit board.

2. Connection device according to claim 1, further comprising for each connector, a projection which engages into a corresponding, preferably plated through recess in the printed circuit board and does not rise above the printed circuit board upper side, by means of which the projections are electrically connected to at least one earth- or potential-surface or corresponding earth- or potential-tracks on the printed circuit board, which are provided or formed on the first or upper side, lying opposite the second or lower side of the printed circuit board.

3. Connection device according to claim 1, wherein the ends of the projections terminate before the plane of the upper side of the printed circuit board.

4. Connection device according to claim 1, wherein the recesses are arranged in the printed circuit board so that a patch antenna, can be positioned therebetween.

5. Connection device according to claim 1, wherein the recesses in the printed circuit board are arranged so that a patch antenna is positioned on the printed circuit board upper side so that only one part of the recesses and therefore part of the projections present therein are covered by the patch antenna positioned on the printed circuit board upper side.

6. Connection device according to claim 1, wherein the projections are provided as axial extension of a section of the outer contacts of the connectors.

7. Connection device according to claim 1, wherein the connector unit consists of a die-cast part, particularly a metal die-cast part.

8. Connection device according to claim 1, wherein the connectors, which are mechanically solidly linked to one another by a connecting frame, are formed from a turned and/or milled part.

9. Connection device according to claim 1, wherein the connectors are configured by means of the connecting bridges and/or the connecting frames comprising the connecting bridges or connecting device in the form of an orbiting closed frame.

10. Connection device according to claim 1, wherein the connectors are implemented by means of the connecting bridges and/or the connecting frame comprising the connecting bridges or connecting device as open connecting device.

11. Connection device according to claim 1, wherein the free space (X1) between the connector unit and the adjacent side of the printed circuit board at least in sections is more than 0.5 mm, particularly more than 130 mm and preferably less than 5 mm, particularly less than 4 mm, 3 mm or 2 mm respectively 1.5 mm.

12. Connection device according to claim 1, wherein the connector unit is constructed as an SMD modular unit.

13. Connection device according to claim 1, wherein the connector unit comprises a housing, which is mounted on the connectors and which surrounds the outer contacts in such a way that the connections lie free.

14. Connection device according to claim 1, further comprising at least two coaxial connectors, which as shielded coaxial connectors are provided with a conductive outer contact.

15. Connection device according to claim 1, wherein the at least one center contact of a single-pole or multi-pole unshielded connector rises above a base section.

16. Connection device according to claim 1, wherein the center contacts of a multi-pole shielded connector are surrounded by an extension, which rises above the base section and is part of the outer contact.

17. Connection device according to claim 1, wherein the center contacts have printed circuit board-side center contact ends, which are electrically bonded on the printed circuit board lower side.

18. Connection device according to claim 17, wherein the free ends of the projections of the connectors protrude further than the center contact ends.

19. Connection device according to claim 1, wherein the connectors are linked by a connecting frame and/or by connecting bridges to form a solid connector unit.

20. Connection device according to claim 19, wherein the connector unit, on the lower side facing the printed circuit board is provided with projections, which run parallel with the axes of the connectors, whereby the connecting frame and/or the connecting bridges are electrically conductive.

21. Connection device according to claim 1, wherein the connectors are firmly linked to one another by a connecting frame and/or connecting bridges, which consist of electrically non-conductive material.

22. Connection device according to claim 21, wherein an electrically conductive connection part or metal plate is provided, which is electrically and mechanically bonded with the outer contacts of the connectors, whereby the connection part or metal plate lies and/or is supported on the printed circuit board side on the connecting frame and/or the connecting bridges and provided with electrically conductive projections, running parallel with the axial direction of the connectors.

23. Connection device according to claim 1, wherein the outer contacts of the connectors are provided with radially protruding earth-connecting shoulders, on which projections running parallel with the axes of the connectors are formed.

24. Connection device according to claim 23, wherein in the assembled state the printed circuit board-side boundary surfaces of the connectors lie at least at a small distance to the lower side of the printed circuit board.

25. Connection device according to claim 23, wherein the projections rise out from a support or boundary surface, which is formed on that of the printed circuit board lower side of the connector unit, the earth connection shoulders and/or of the connection part or metal plate, whereby the support or boundary surface in the assembled state lies on the lower side of the printed circuit board.

26. Connection device according to claim 25, wherein the connecting frame and/or the connecting bridges and/or the electrically conductive connection part or metal plate in the assembled state lies at a distance to the lower side of the printed circuit board, as a result of which an area for feeder cables is created on the printed circuit board lower side.

27. Connection device according to claim 1, wherein the printed circuit board can be anchored in an understructure or chassis of a vehicle antenna, whereby recesses are formed in the understructure or chassis, as a result of which the connectors rise above the side opposite the printed circuit board of the understructure or chassis for connection to second coaxial connectors.

28. Connection device according to claim 27, wherein the connectors are mechanically bonded with the understructure or chassis indirectly by means of the interposed printed circuit board.

29. Connection device according to claim 1, wherein at least one second connector is provided, which is formed as single-pole or multi-pole unshielded connector or as shielded two-pole or multi-pole connector.

30. Connection device according to claim 29, wherein the at least one single-pole unshielded or multi-pole shielded or unshielded connector has an outer contact form and/or dimensioning deviating from the form of the outer contacts of the shielded connectors.

31. Connection device according to claim 29, wherein the at least one single-pole unshielded or multi-pole shielded or unshielded connector has an outer contact form and/or dimensioning equal to the form of the outer contacts of the shielded connectors.

32. Connection device according to claim 29, wherein the connectors are arranged in the corner areas of an n-polygonal connector unit, preferably in the corners of a rectangular or square connector unit or one approximate to this shape.

33. Connection device according to claim 29, wherein the shielded coaxial connectors are arranged in the corners of an n-polygonal connector unit and that the at least additionally provided unshielded connector and/or the at least additionally provided multi-pole connector is arranged between two shielded coaxial connectors.

* * * * *